US005993262A

United States Patent [19]

Kowdynski et al.

[11] Patent Number: 5,993,262

[45] Date of Patent: Nov. 30, 1999

[54] ELECTRICAL ADAPTOR

[75] Inventors: Timothy S. Kowdynski, White Lake; Alan Ellish, Highland, both of Mich.

[73] Assignee: Chrysler Corporation, Auburn Hills, Mich.

[21] Appl. No.: 09/080,542

[22] Filed: May 18, 1998

[51] Int. Cl.[6] ..... H01R 25/00

[52] U.S. Cl. ..... 439/638; 439/35; 439/668

[58] Field of Search ..... 439/638, 35, 668

[56] References Cited

U.S. PATENT DOCUMENTS

| | | | |
|---|---|---|---|
| 4,647,139 | 3/1987 | Yang | 439/483 |
| 4,770,644 | 9/1988 | Feder | 439/166 |
| 5,044,993 | 9/1991 | El-Haj et al. | 439/668 |
| 5,217,395 | 6/1993 | Bailey et al. | 439/668 |
| 5,230,641 | 7/1993 | Wharton | 439/668 |
| 5,281,147 | 1/1994 | Hughes | 439/35 |
| 5,354,204 | 10/1994 | Hughes | 439/35 |
| 5,372,522 | 12/1994 | Hoeft | 439/535 |
| 5,443,389 | 8/1995 | Hughes | 439/35 |
| 5,514,009 | 5/1996 | Hughes | 439/35 |
| 5,564,943 | 10/1996 | Weiss | 439/668 |
| 5,593,323 | 1/1997 | Dernehl | 439/668 |
| 5,599,204 | 2/1997 | Glassford | 439/638 |
| 5,626,479 | 5/1997 | Hughes | 439/35 |
| 5,766,020 | 6/1998 | Hughes | 439/35 |

*Primary Examiner*—Paula Bradley
*Assistant Examiner*—Tho D. Ta
*Attorney, Agent, or Firm*—Roland A. Fuller III

[57] ABSTRACT

The present invention provides an electrical adaptor for transmitting current from a standard seven prong trailer plug power source to a female cigarette lighter plug. The adaptor uses two of the seven prongs of the seven prong trailer plug power source to supply current to the female cigarette lighter plug. The electrical adaptor provides a way of using a standard trailer plug, normally located external to a vehicle, to supply electrical current to an accessory. The adaptor is contained within a cylindrical plastic housing. A thermal insulator is positioned around the female cigarette lighter plug to thermally insulate it from the cylindrical plastic housing.

1 Claim, 2 Drawing Sheets

ELECTRICAL ADAPTOR

BACKGROUND OF THE INVENTION

I. Technical Field

The present invention relates generally to an electrical adaptor and, more particularly, to an electrical adapter which converts a 7-way connector to an accessory power outlet connector.

II. Discussion

Individuals such as campers, hikers, and picnickers sometimes find themselves in locations which have no electrical power source. These individuals are often in need of an electrical power source to power electrical accessories such as portable grilles, lights or coolers. However, many of these accessories have male cigarette lighter plugs which are engageable to the female cigarette lighter plug of a motor vehicle. Thus, if an individual has an accessory with a male cigarette lighter plug and also has a motor vehicle, it is possible to supply power to the accessory by use of the female cigarette lighter plug located in the vehicle.

However, the electrical cord, which electrically connects the accessory to the male cigarette lighter plug, is usually fairly short. Because of the short length of the electrical cord, the accessory must be placed in close proximity with the female cigarette lighter plug. Typically, female cigarette lighter plugs, located in motor vehicles, are positioned on or around the dashboard area. This location is remote from the external environment of the vehicle. Therefore, in order to engage the male cigarette lighter plug, having a relatively short electrical cord, with the female cigarette lighter plug, the accessory must be either positioned in the vehicle and close to the female cigarette lighter plug or the accessory must be provided with some form of cable extension. The present invention was developed in light of these drawbacks.

SUMMARY OF THE INVENTION

The present invention overcomes these drawbacks by providing an electrical adaptor for transmitting current from a seven way trailer plug power source to a male cigarette lighter plug which is electrically connected to an electrical accessory. The adaptor uses two of the outer six prongs of the seven way trailer plug power source to supply current to a female cigarette lighter plug. Thus, the seven way trailer plug, normally located external to a vehicle, is used to supply electrical current to an electrical accessory. In another aspect of the present invention, the electrical adaptor is contained within a cylindrical plastic housing. A thermal insulator is positioned around the female style cigarette plug to thermally insulate it from the cylindrical plastic housing.

Additional advantages and features of the present invention will be apparent from the subsequent description and the appended claims taken in conjunction with the accompanying drawings.

BRIEF DESCRIPTION OF THE DRAWINGS

In the drawings which illustrate the best mode presently contemplated for carrying out the invention.

DETAILED DESCRIPTION OF THE PREFERRED EMBODIMENTS

Figure 1:
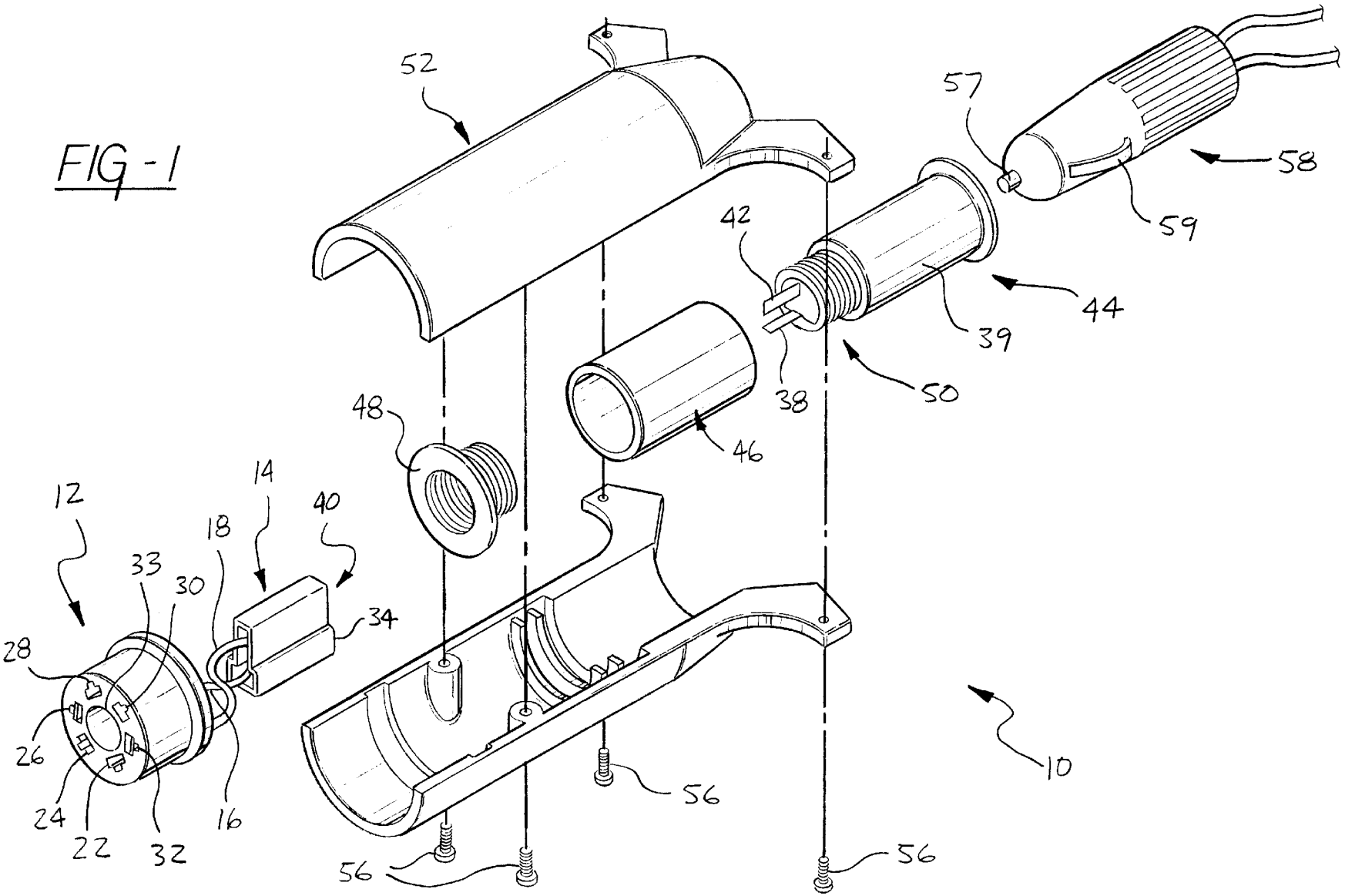
FIG. 1 is an exploded view of an electrical adaptor according to the present invention.

With reference to FIG. 1, the present invention is now described. In FIG. 1, an electrical adaptor 10 is shown having seven prong receiver 12 which is electrically connected to plug 14 by negative wire 16 and positive wire 18. Seven prong receiver 12 has a face with six apertures 22, 24, 26, 28, 30, 32 and center aperture 33 located therein. Aperture 22 is electrically connected to negative wire 16 and aperture 30 is electrically connected to positive wire 18. It is noted that any aperture 22, 24, 26, 28, 30, or 32 may be connected to negative wire 16 or positive wire 18 and this invention is not limited to the disclosure contained herein.

Plug 14 has negative aperture 34 for engaging negative lead 38 and positive aperture 40 for engaging positive lead 42. This engagement is obtained by simply "plugging in" negative lead 38 and positive lead 42 into negative aperture 34 and positive aperture 40 respectively. Negative wire 16 electrically communicates with negative aperture 34 and positive wire 18 electrically communicates with positive aperture 40.

Positive lead 42 electrically communicates with a center portion (not shown) of female cigarette lighter plug 44. Likewise, negative lead 38 electrically communicates with an outer portion 39 of female cigarette lighter plug 44. Thus, outer portion 39 and negative lead 38 may be formed of one conductive material such that any area of outer portion 39 grounds through negative lead 38. Likewise, positive lead 38 electrically communicates with center portion (not shown) and is electrically insulated from negative lead 38 and outer portion 39. Such designs of cigarette lighter plugs are well known in the art.

Thermal insulator 46 slides over female cigarette lighter plug 44. Cap 48 screws on to threaded portion 50 of female cigarette lighter plug 44, thereby locking thermal insulator 46 around female cigarette lighter plug 44.

Outer shell 52 encapsulates female cigarette lighter plug 44, thermal insulator 46, cap 48, plug 14, negative wire 16, positive wire 18, and seven prong receiver 12. This encapsulation occurs by an upper portion of outer shell 52 being locked together with a lower portion of outer shell 52 by screws 56. Outer shell 52 is preferably made of plastic but may be made of any other suitable material such as aluminum or metal.

With reference to FIG. 1, the operation of the present invention will now be described. Apertures 22, 24, 26, 28, 30, 32 and center aperture 33 are adaptable to receive a standard seven way trailer plug power source 64 located at the rear end of a vehicle 62, such as an automobile (refer to FIG. 2). The seven way trailer plug power source 64 supplies power to apertures 24, 26, 28, 30, and 32, and grounds through aperture 22. Aperture 30 supplies power to positive wire 18 which, through positive aperture 40, supplies power to positive lead 42. Positive lead 42, in turn, supplies power to center area 57 of male cigarette lighter plug 58. To complete the circuit, an accessory 66 (see FIG. 2) which is electrically attached to male cigarette lighter plug 58 is grounded by pressing engagement of spring contact 59 against outer surface 39 of female cigarette lighter plug 44. Female cigarette lighter plug 44 is grounded through negative lead 38 which electrically communicates with negative aperture 34 which, in turn, electrically communicates with aperture 22 through negative wire 16. Thereby, a complete circuit is formed through the accessory which electrically communicates with male cigarette lighter plug 58. Thermal insulator 46 ensures that any heat generated by female cigarette lighter plug 44 does not damage or melt outer shell 52. Likewise, outer shell 52 ensures that all the components contained therein are not damaged.

Figure 2:
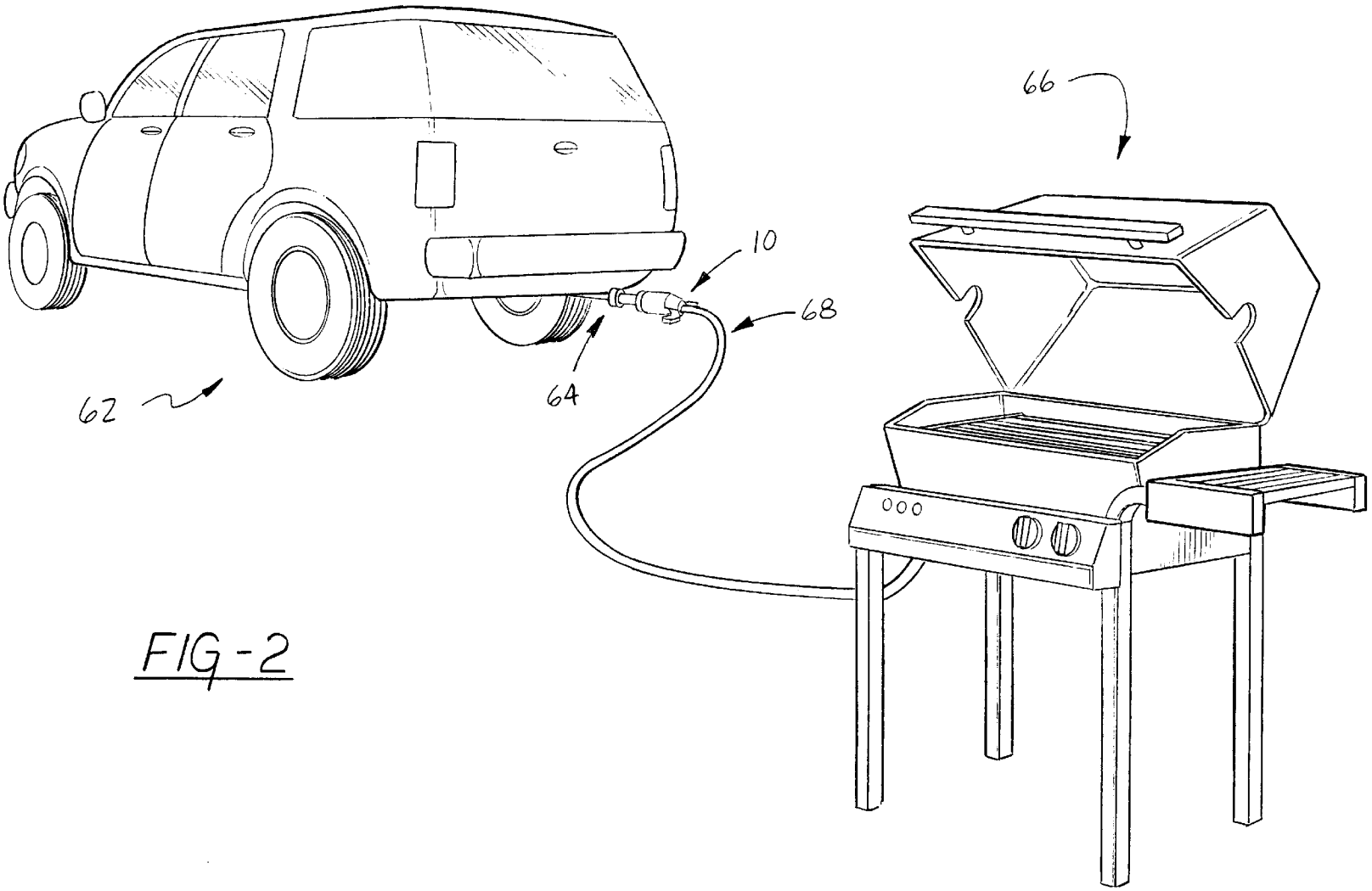
FIG. 2 is an environmental view of an electrical adaptor being used with an automobile and an electrical accessory according to the present invention.

Referring to FIG. 2, electrical adaptor 10 is shown being used to supply electrical power from automobile 62, having seven way trailer plug 64, to accessory 66, such as a grille. Because the electrical adaptor 10 allows power from seven way trailer plug 64 to be provided to accessory 66, accessory 66 may be located external to automobile 62 and still have a relatively short extension cord 68.

While the above detailed description describes the preferred embodiment of the present invention, it should be understood that the present invention is susceptible to modification, variation, and alteration without deviating from the scope and fair meaning of the subadjoined claims.

What is claimed is:

1. An electrical adaptor for transmitting current from a vehicle trailer plug to an accessory, the electrical adaptor comprising:

a vehicle;

a seven prong trailer plug being supplied electrical power by the vehicle;

a seven prong adaptor plug having seven apertures engageable to the seven prong trailer plug;

a first of the seven apertures electrically connected to a positive aperture of a female plug by a positive wire, a second of the seven apertures electrically connected to a negative aperture of the female plug by a negative wire;

a female cigarette lighter plug, the female cigarette lighter plug having a positive lead and a negative lead, the positive lead selectively engageable to the positive aperture of the female plug, the negative lead selectively engageable to the negative aperture of the female plug;

a thermal-insulator surrounding an exterior of the female cigarette lighter plug;

a housing encapsulating the female cigarette lighter plug, the seven prong adaptor plug, the female plug, the positive wire, the negative wire and the thermal-insulator; and an accessory in electrical communication with a male cigarette lighter plug, the male cigarette lighter plug selectively engageable to the female cigarette lighter plug.

* * * * *